US009936772B2

(12) United States Patent
Paik

(10) Patent No.: US 9,936,772 B2
(45) Date of Patent: Apr. 10, 2018

(54) BUCKLE FOR CHEST STRAP OF KNAPSACK

(71) Applicant: Jisook Paik, Seoul (KR)

(72) Inventor: Jisook Paik, Seoul (KR)

( * ) Notice: Subject to any disclaimer, the term of this patent is extended or adjusted under 35 U.S.C. 154(b) by 79 days.

(21) Appl. No.: 15/299,130

(22) Filed: Oct. 20, 2016

(65) Prior Publication Data

US 2017/0172262 A1 Jun. 22, 2017

(30) Foreign Application Priority Data

Dec. 22, 2015 (KR) ..... 10-2015-0183422

(51) Int. Cl.

| | |
|---|---|
| ***A44B 11/25*** | (2006.01) |
| ***A45F 3/04*** | (2006.01) |
| *A45F 3/00* | (2006.01) |
| *A44B 11/00* | (2006.01) |
| *A45C 13/10* | (2006.01) |
| *A45F 3/14* | (2006.01) |
| *A45F 3/16* | (2006.01) |

(52) U.S. Cl.

CPC ..... *A44B 11/2592* (2013.01); *A44B 11/2588* (2013.01); *A45F 3/047* (2013.01); *A44B 11/005* (2013.01); *A44D 2201/02* (2013.01); *A44D 2203/00* (2013.01); *A45C 13/1069* (2013.01); *A45C 13/1092* (2013.01); *A45F 3/04* (2013.01); *A45F 2003/008* (2013.01); *A45F 2003/144* (2013.01); *A45F 2003/166* (2013.01)

(58) Field of Classification Search

CPC ..... A45F 3/047; A44B 11/2592; Y10T 24/32

USPC ..... 24/303

See application file for complete search history.

(56) References Cited

U.S. PATENT DOCUMENTS

| | | | | |
|---|---|---|---|---|
| 2,615,227 A * | 10/1952 | Hornik | A44C 5/2071 | 24/303 |
| 2,648,884 A * | 8/1953 | Loofboro | A44C 5/2071 | 24/303 |
| 3,192,747 A * | 7/1965 | Stupell | A44B 15/002 | 2/338 |
| 3,293,714 A * | 12/1966 | Shafer | A44B 11/2596 | 24/303 |

(Continued)

FOREIGN PATENT DOCUMENTS

| | | |
|---|---|---|
| KR | 10-0501498 B1 | 7/2005 |
| KR | 10-1132100 B1 | 4/2012 |

*Primary Examiner* — Jason W San

(74) *Attorney, Agent, or Firm* — Novick, Kim & Lee, PLLC; Jae Youn Kim

(57) ABSTRACT

Provided is a buckle for a chest strap of a knapsack, including a plug member including a plug plane portion formed at a front side of a base so as to be connected to the base via a plug inner-side slope, a plug front-end slope extending forward from the plug plane portion, a first magnet embedded in a middle portion of the plug plane portion, and coupling protrusions protruding from opposite sides of the first magnet, and a socket member including a socket plane portion formed at a front side of a base so as to be connected to the base via a socket inner-side slope, a socket front-end slope extending forward from the socket plane portion, a second magnet embedded in a middle portion of the socket plane portion, and coupling recesses formed in opposite sides of the second magnet so as to correspond to the respective coupling protrusions.

10 Claims, 10 Drawing Sheets

(56) References Cited

U.S. PATENT DOCUMENTS 3,589,341 A * 6/1971 Krebs ..... A01K 27/005 119/865
4,121,324 A * 10/1978 Marbacher ..... A41F 1/002 24/303
4,231,137 A * 11/1980 Fujimoto ..... A44C 5/2071 24/303
5,664,298 A * 9/1997 Nessar-Ivanovic .. A44C 5/2071 24/303
5,826,309 A * 10/1998 Tsamas ..... A44C 5/2052 24/265 WS
6,163,938 A * 12/2000 Weber-Unger ..... A41F 1/002 24/303
6,292,985 B1 * 9/2001 Grunberger ..... A44B 11/2592 24/303
6,505,385 B2 * 1/2003 Grunberger ..... A44B 11/2592 24/303
6,598,271 B2 * 7/2003 Nire ..... A41F 1/002 24/265 WS
6,606,767 B2 * 8/2003 Wong ..... A41F 1/006 24/303
6,622,349 B2 * 9/2003 Wong ..... A41F 1/006 24/303
6,698,070 B2 * 3/2004 Chen ..... A44B 11/006 24/185
6,804,865 B2 * 10/2004 Grunberger ..... A41F 1/002 24/303
6,857,169 B2 * 2/2005 Chung ..... A44B 11/258 24/303
7,496,994 B1 * 3/2009 Headley ..... A44C 5/2019 24/303
8,196,268 B1 * 6/2012 Placeres ..... A41F 1/002 24/303
8,359,716 B2 * 1/2013 Fiedler ..... A44B 11/25 24/303
8,430,434 B2 * 4/2013 Fiedler ..... A44B 11/258 292/251.5
8,484,809 B2 * 7/2013 Fiedler ..... A45C 13/1069 220/230
8,505,174 B2 * 8/2013 Fildan ..... A41F 1/002 24/303
8,914,951 B2 * 12/2014 Gaudillere ..... A44B 11/266 24/303
9,307,808 B1 * 4/2016 Lill ..... A44B 11/2584
9,635,919 B2 * 5/2017 Fiedler ..... A45C 13/10
2003/0229974 A1 * 12/2003 Zemer ..... A44C 5/2076 24/303
2007/0271739 A1 * 11/2007 Slautterback ..... A44B 11/2592 24/265 R
2009/0070970 A1 * 3/2009 Lundh ..... A44B 11/2592 24/489
2010/0263171 A1 * 10/2010 Paik ..... A44B 11/25 24/194
2012/0044031 A1 * 2/2012 Ninomiya ..... H01F 7/0263 335/219
2015/0135486 A1 * 5/2015 Fiedler ..... A44B 11/2584 24/303

* cited by examiner

BUCKLE FOR CHEST STRAP OF KNAPSACK

CROSS-REFERENCE TO RELATED APPLICATION

This application claims the priority to Korean patent application No. 10-2015-0183422 filed on Dec. 22, 2015, the disclosure of which is incorporated by reference in its entirety.

BACKGROUND OF THE INVENTION

Field of the Invention

The present invention relates to a buckle for a chest strap of a knapsack, and more particularly, to a buckle for a chest strap of a knapsack, which may be connected to a shoulder strap so as to be adjustable in height along the shoulder strap, may provide simplified fastening and unfastening thereof, and may allow a hose for a water bottle or some other small article to be easily attached thereto and carried.

Description of the Related Art

A buckle for use in, for example, knapsacks refers to a fastening device in which two members are coupled and fixed to each other. A general buckle is manufactured by molding two members from a plastic material so as to implement elastic coupling therebetween, and thus has widely been used because it is light and easily fastened.

FIG. 1 is a perspective view illustrating a general knapsack by way of example. As illustrated in FIG. 1, various shapes of straps are provided on the rear surface of a knapsack 1 in order to assist a wearer in wearing the knapsack 1. That is, a basic shoulder strap 2 to be slung over the shoulder, a waist strap 3 to be worn around the waist, and a chest strap 4 to be worn around the chest are provided.

Among these, the chest strap 4 is used to bind a pair of shoulder straps 2 to each other so as to prevent the upper end of the knapsack from tilting backward and to bring the knapsack into close contact with the human body, thereby functioning to prevent shaking of the knapsack and to maintain a stabilized worn state of the knapsack.

In addition, the chest strap 4 is configured so as to vertically move along the shoulder straps 2 while being supported at opposite ends thereof by the shoulder straps 2. As such, the height of the chest strap 4 is adjustable to suit the body of the wearer of the knapsack.

More specifically, the middle portion of the chest strap 4 is separably connected using a fastening buckle 5, which includes female and male pieces, and opposite ends of the chest strap 4 are provided with connection buckles 6 so that the ends of the chest strap 4 are connected to the shoulder straps 2 via the connection buckles 6. In addition, a guide strap 7 for guiding the vertical movement of the chest strap 4 is installed on the outer surface of each shoulder strap 2 and is coupled to the connection buckle 6.

Accordingly, when it is desired to adjust the height of the chest strap 4, the wearer may grip opposite ends of the chest strap 4 and push up or down the chest strap 4 while gripping the shoulder straps 2. However, because of the connection buckles 6 supported by the shoulder straps 2 as well as support pieces, vertically moving the connection buckles 6 is very inconvenient and adjustment of the height of the chest strap 4 is not easy.

In addition, the conventional strap connection structure described above has a complicated configuration, causing increased manufacturing costs, lowered productivity, and deterioration in aesthetic appearance.

Patent Document 1, which was developed to solve the problem described above, discloses rails installed on outer surfaces of shoulder straps so as to vertically extend a long length, and elevating buckles installed respectively on opposite ends of a chest strap so as to be coupled to the respective rails, such that the height of the chest strap may be simply adjusted merely via manipulation of the elevating buckles, which provides increased convenience in use.

Patent Document 2 discloses a further improvement of Patent Document 1. Considering Patent Document 2, in a chest strap including a plug member, a socket member, and an elevating buckle, the elevating buckle is integrally included in any one member among the plug member and the socket member, and a magnet is mounted in the other member so that various small articles may be attached to and carried along with the chest strap.

As described above, Patent Document 1 and Patent Document 2, which were previously registered by the applicant of the present invention, achieve improved productivity attributable to a reduction in the number of constituent elements of the chest strap, and enable the convenient use of the chest strap while imparting the chest strap with a more aesthetically pleasing appearance. In particular, Patent Document 2 achieves excellent convenience in use through the provision of the magnet, which may temporarily hold and carry a hose of a water bottle or some other small article.

The conventional buckles described above, however, require high technical skill for the manufacture thereof because of a complicated configuration, i.e. because a pair of lock arms having a complicated configuration are provided and because a chamber in the socket member, which is required in order to accommodate the lock arms, and a coupling structure inside the chamber for fastening the lock arms have a complicated configuration. Moreover, in Patent Document 2, a complicated configuration for mounting the magnet therein is added to the side portion, which causes increased manufacturing costs and difficulty in manufacture.

In particular, in the buckles for the chest strap in Patent Document 1 and Patent Document 2, the connection of the plug member and the socket member requires the user to grip the plug member and the socket member with both hands so as to insert one into the other by applying pressure thereto. In the same manner, the separation of the plug member and the socket member requires the user to grip the plug member and the socket member with both hands so as to push and separate the lock arms of the plug member. As described above, the conventional buckle for the chest strap may be fastened only when the user accurately couples the plug member and the socket member to each other using both hands.

PRIOR ART DOCUMENT

Patent Document

1. Korean Registered Patent No. 10-0501498
2. Korean Registered Patent No. 10-1132100

SUMMARY OF THE INVENTION

Therefore, the present invention has been made in view of the above problems of the related art, and it is one object of the present invention to provide a buckle for use in a chest strap of a knapsack, in which a plug member and a socket member may have a very simplified configuration and may be simply coupled to each other.

It is another object of the present invention to provide a buckle for a chest strap of a knapsack, in which coupling between a plug member and a socket member is implemented even when they are simply brought close to each other, which enables convenient fastening and unfastening of the buckle using only one hand.

It is a further object of the present invention to provide a buckle for a chest strap of a knapsack, to which a water supply hose or some other small article may be simply attached and carried by magnetic force.

In accordance with an aspect of the present invention, the above and other objects can be accomplished by the provision of a buckle for a chest strap of a knapsack, including a plug member including a plug plane portion formed at a front side of a base so as to be connected to the base via a plug inner-side slope, a plug front-end slope extending forward from the plug plane portion, a first magnet embedded in a middle portion of the plug plane portion, and coupling protrusions protruding from opposite sides of the middle portion of the plug plane portion, and a socket member including a socket plane portion formed at a front side of a base so as to be connected to the base via a socket inner-side slope, a socket front-end slope extending forward from the socket plane portion, a second magnet embedded in a middle portion of the socket plane portion, and coupling recesses formed in opposite sides of the middle portion of the socket plane portion so as to correspond to the respective coupling protrusions, wherein the plug member and the socket member are separably connected to each other.

According to an exemplary feature of the present invention, each of an exterior angle between the plug plane portion and the plug inner-side slope, an interior angle between the plug plane portion and the plug front-end slope of the plug member, an exterior angle between the socket plane portion and the socket inner-side slope, and an interior angle between the socket plane portion and the socket front-end slope of the socket member may be an obtuse angle.

When the plug member and the socket member are coupled to each other so that the plug plane portion and the socket plane portion are attached to face each other by the first and second magnets, the plug front-end slope and the socket inner-side slope may be located close to each other so as to face each other, and the socket front-end slope and the plug inner-side slope may be located close to each other so as to face each other.

According to another feature of the present invention, each of the coupling protrusions of the plug member may include a hook portion formed on an inner front end thereof and a curvilinearly curved portion formed on an outer surface thereof, and each of the coupling recesses of the socket member may include a raised portion formed on an outer circumference thereof so as to correspond to the hook portion of the coupling protrusion.

According to another feature of the present invention, the coupling recess of the socket member may further include an inclined guide portion formed on an inner circumference thereof so as to define an upwardly expanded opening so that the inclined guide portion comes into contact with the curvilinearly inclined portion to enable easy separation of the coupling protrusion of the plug member from the coupling recess.

According to another feature of the present invention, each of the plug member and the socket member may include a crossbar and a strap-hooking bar, which are selectively formed at a rear side of the base.

According to another feature of the present invention, the plug member or the socket member may include an elevating rail holder provided on a rear end thereof.

According to another feature of the present invention, the plug member may include a seating recess formed in an outer surface thereof so that an external magnet, which corresponds to the first magnet embedded in the plug member, is seated.

The seating recess and the embedded first magnet may be connected to each other via an aperture, and the seating recess may be provided on a circumference thereof with a protruding support portion to support the external magnet seated in the seating recess.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE INVENTION

Figure 1:
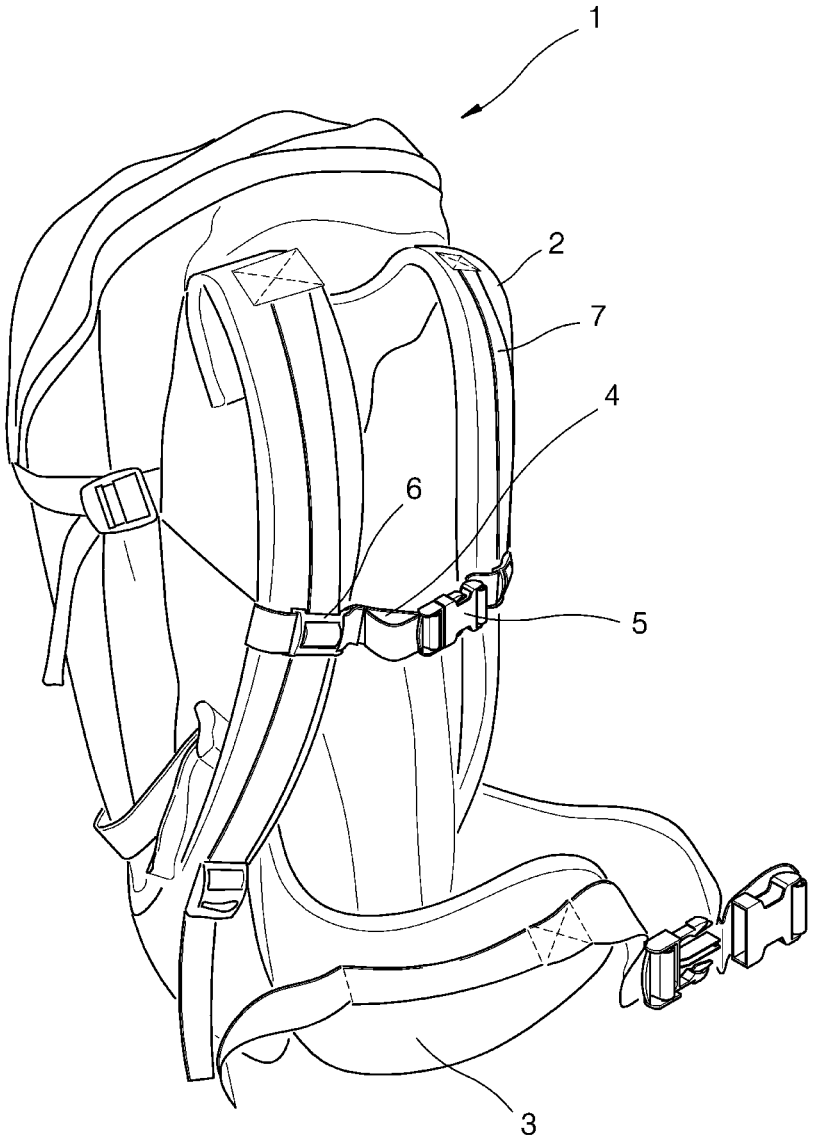
FIG. 1 is a perspective view illustrating an example of a conventional knapsack.
Figure 2:
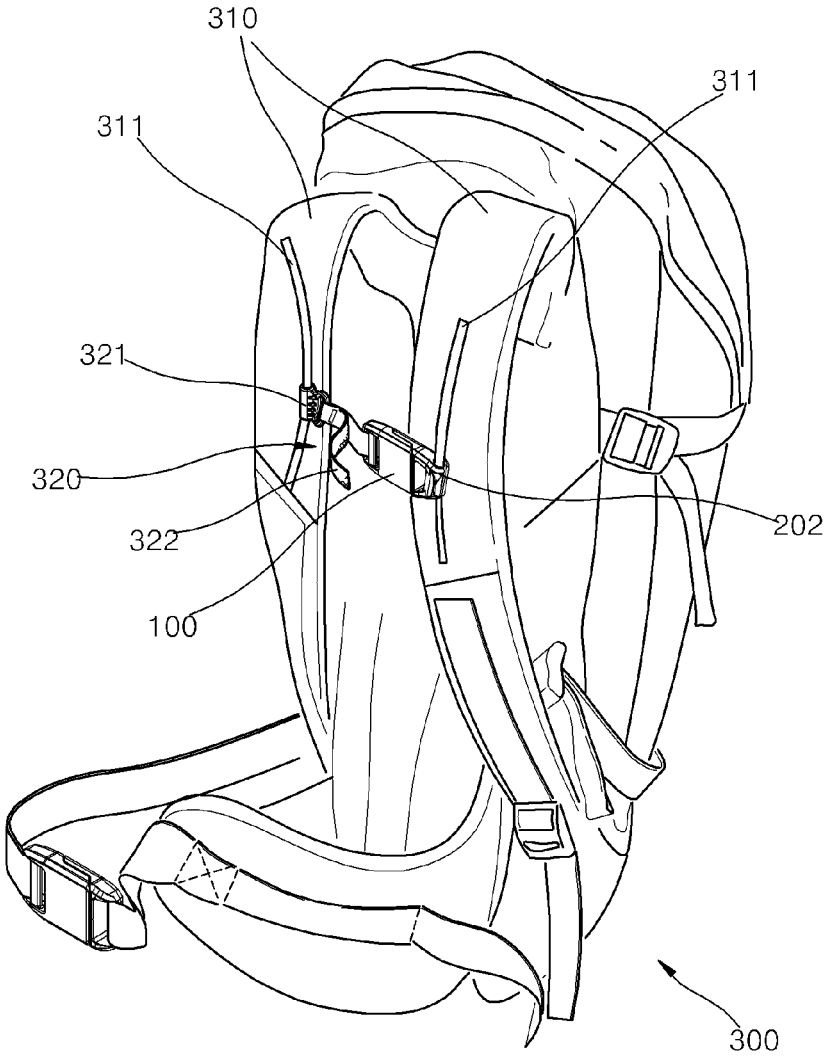
FIG. 2 is a view illustrating an embodiment in which the present invention is applied to a knapsack.
Figure 3:
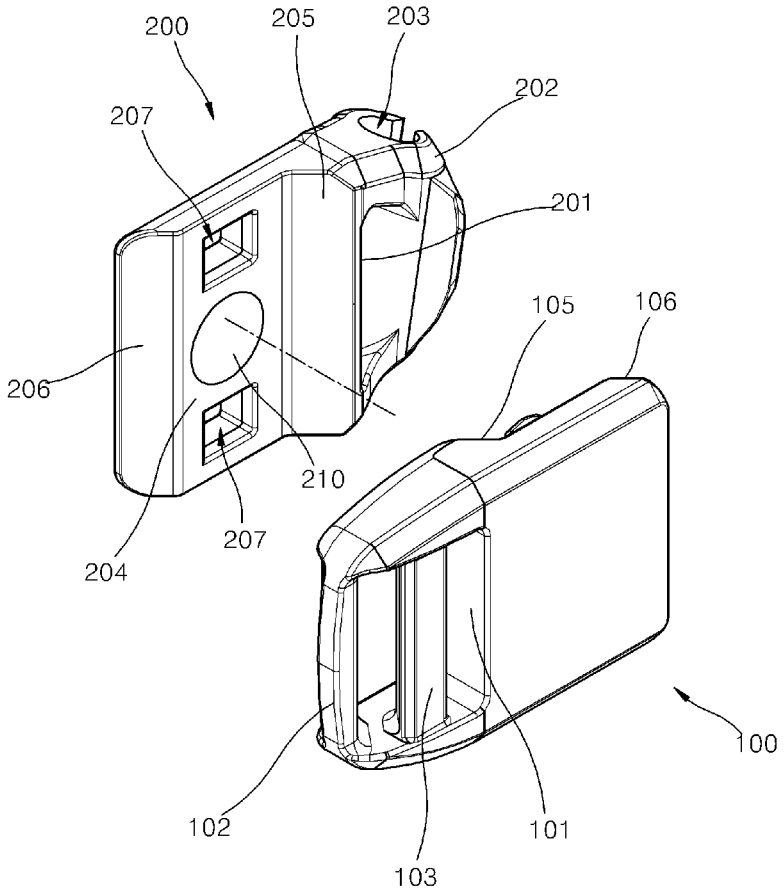
FIG. 3 is an exploded perspective view illustrating an embodiment of a buckle according to the present invention.
Figure 4:
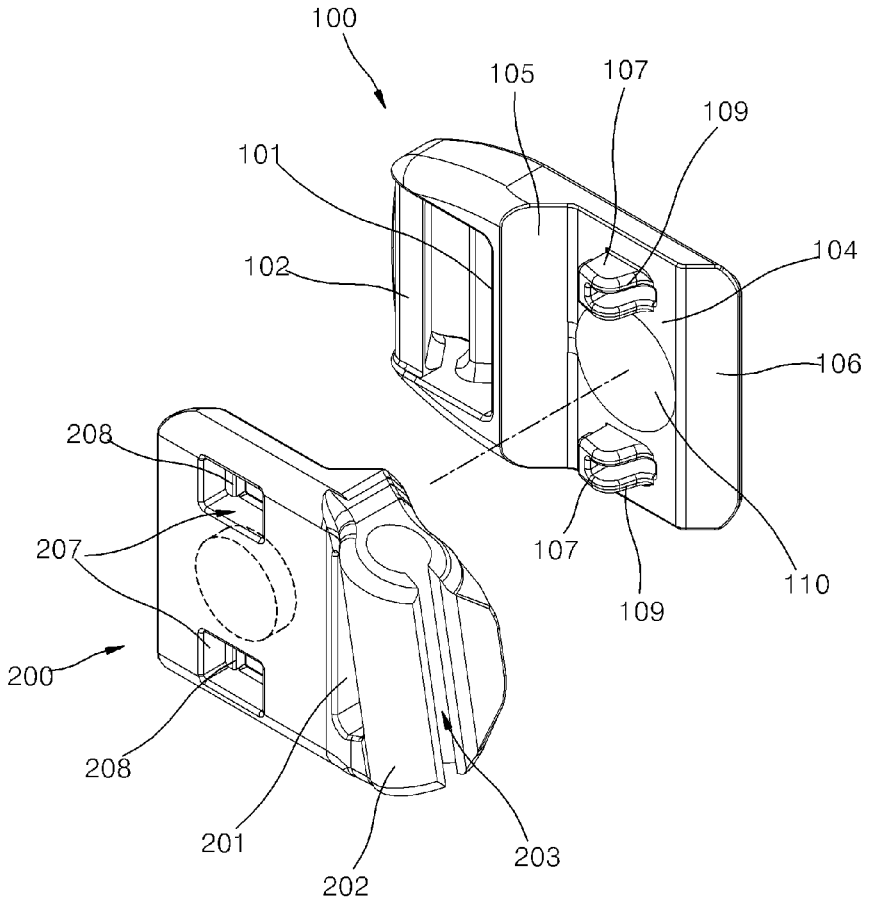
FIG. 4 is a rear exploded perspective view of FIG. 3.
Figure 5:
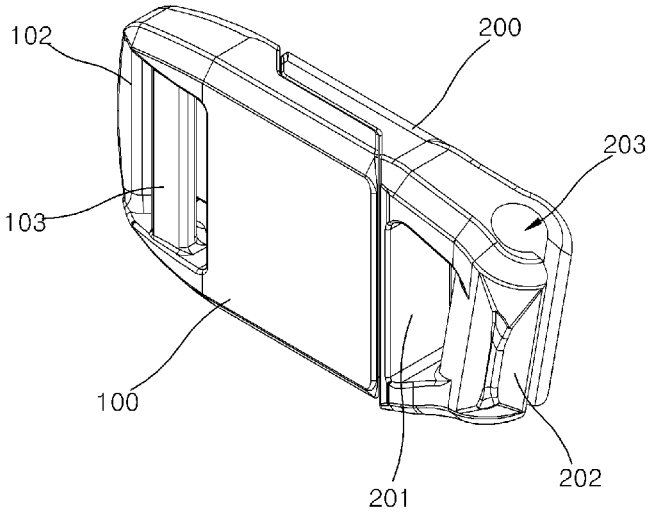
FIG. 5 is a perspective view illustrating the coupled state of the buckle according to the present invention.
Figure 6:
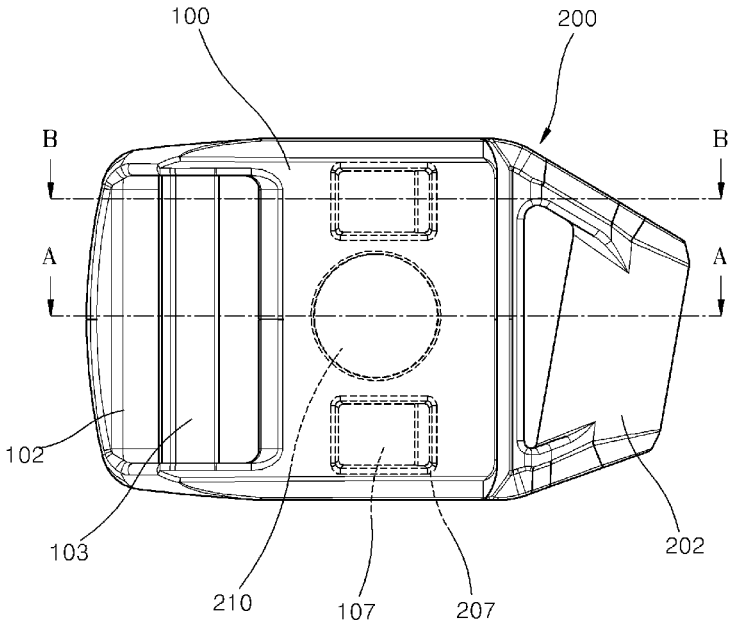
FIG. 6 is a front view illustrating the coupled state of the buckle according to the present invention.
Figure 7:
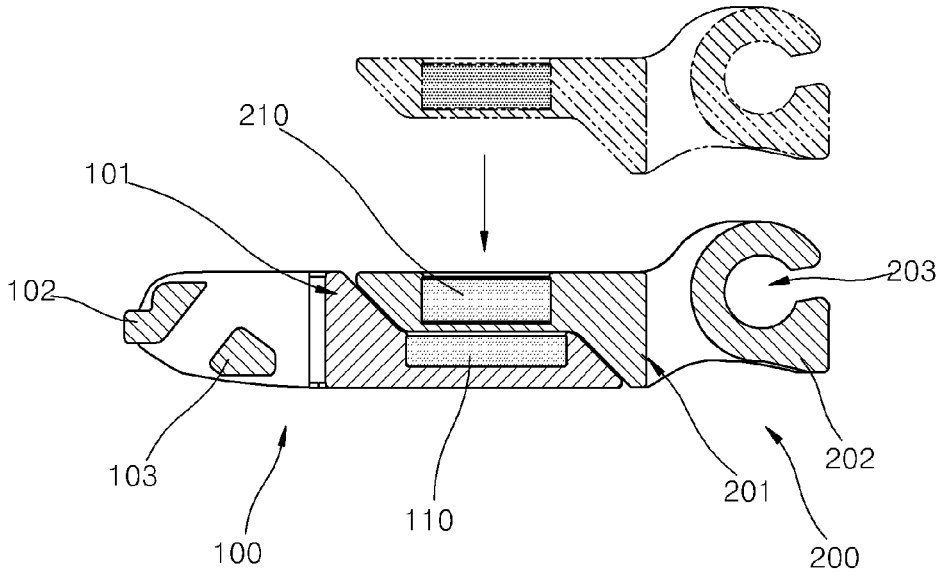
FIG. 7 is a sectional view taken along line A-A of FIG. 6.
Figure 8:
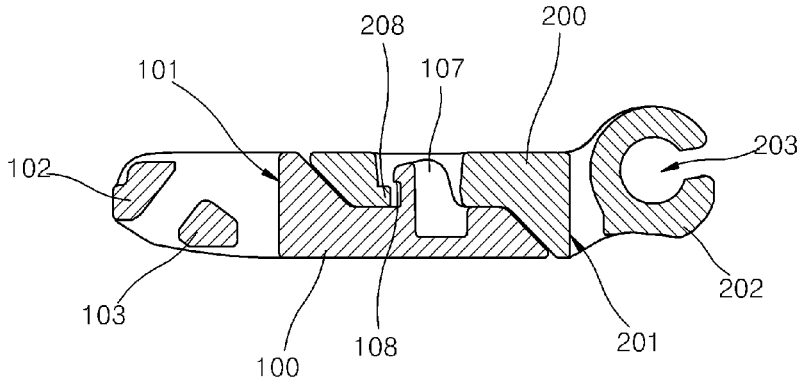
FIG. 8 is a sectional view taken along line B-B of FIG. 6.
Figure 9:
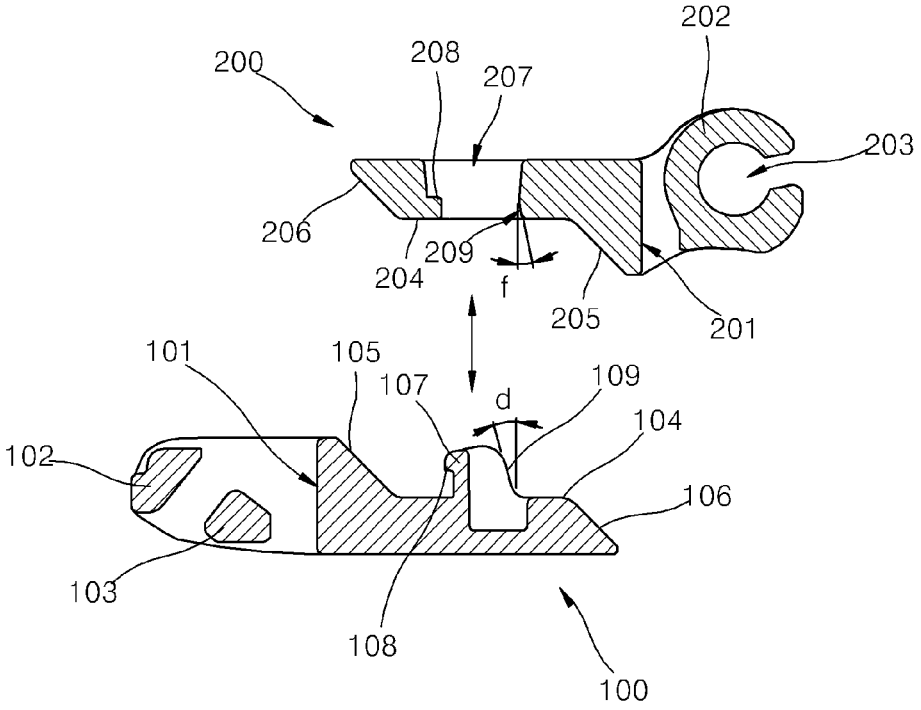
FIG. 9 is a sectional view illustrating the separated state of FIG. 8.

FIG. 2 is a view illustrating an embodiment in which the present invention is applied to a knapsack, FIG. 3 is an exploded perspective view illustrating an embodiment of a buckle according to the present invention, FIG. 4 is a rear exploded perspective view of FIG. 3, FIG. 5 is a perspective view illustrating the coupled state of the buckle according to the present invention, FIG. 6 is a front view illustrating the coupled state of the buckle according to the present invention, FIG. 7 is a sectional view taken along line A-A of FIG. 6, FIG. 8 is a sectional view taken along line B-B of FIG. 6, and FIG. 9 is a sectional view illustrating the separated state of FIG. 8.

Referring to FIGS. 2 to 9, the buckle according to the present invention broadly includes a plug member 100 and a socket member 200, which are separably coupled to each other. Both members are generally molded using a synthetic resin, and are used by being installed to a chest strap 320 of a knapsack 300, as illustrated in FIG. 2, which is a view illustrating the buckle in use.

More specifically, the chest strap 320 is connected to the upper middle portions of shoulder straps 310, which are installed on the back surface of the knapsack 300, so as to extend therebetween. A vertically elongated rail 311 is installed on the outer surface of each shoulder strap 310, and the chest strap 320 is vertically movably installed on the rail 311. In order to couple or separate the middle portion of the chest strap 320, the plug member 100 and the socket member 200 according to the present invention are installed thereon.

Each of the plug member 100 and the socket member 200 may be provided with an elevating buckle 321, which has a rail groove for coupling with the rail 311 and is connected to the member via a strap 322, or an elevating rail holder 202 having a rail groove 203 may be integrally formed with each of the plug member 100 and the socket member 200. In the embodiment illustrated in the drawings, the strap 322 is connected to the plug member 100, and the elevating rail holder 202 is integrally formed with the socket member 200.

The reason why at least one of the plug member 100 and the socket member 200 is connected to the elevating buckle 321 via the strap 322 is to allow the chest strap 320 to be adjusted in height so as to be suitable for the user's body by adjusting the length of the strap 322.

The rail groove of the elevating buckle 321, the rail groove 203 formed in the socket member 200, and the rail 311 installed on the shoulder strap 310 have a circular cross section, so that the rail 311 of the shoulder strap 320 is movably fitted into each rail groove, which may cause vertical movement of the chest strap 320.

The plug member 100 includes a base 101, and a crossbar 102 and a strap-hooking bar 103, which are located side by side at the rear side of the base 101 and extend in the transverse direction of the plug member 100 so as to fix a free end of the strap 322. A plug plane portion 104 is formed at the inner front side of the base 101 and is connected to the base 101 via a plug inner-side slope 105. A plug front-end slope 106 extends forward from the plug plane portion 104.

Here, the exterior angle between the plug plane portion 104 and the plug inner-side slope 105 and the interior angle between the plug plane portion 104 and the plug front-end slope 106 may be the same obtuse angle. As such, the plug inner-side slope 105 and the plug front-end slope 106 are parallel to each other.

A first magnet 110 is embedded in the middle portion of the plug plane portion 104, and coupling protrusions 107 protrude from opposite sides of the first magnet 110 toward the socket member 200.

The elevating rail holder 202, which has a rail groove 203 having a circular cross section, is located at the rear side of a base 201 of the socket member 200, and a socket plane portion 204 is formed at the outer front side of the base 201 and is connected to the base 201 via a socket inner-side slope 205. In addition, a socket front-end slope 206 extends forward from the socket plane portion 204.

Here, the exterior angle between the socket plane portion 204 and the socket inner-side slope 205 and the interior angle between the socket plane portion 204 and the socket front-end slope 206 may be the same obtuse angle. As such, the socket inner-side slope 205 and the socket front-end slope 206 are parallel to each other.

A second magnet 210 is embedded in the middle portion of the socket plane portion 204, and coupling recesses 207 are formed in opposite sides of the second magnet 210.

As illustrated in the sectional views of FIGS. 7 and 8, the plane portion 104 and the respective slopes 105 and 106 of the plug member 100 are configured so as to correspond to and come into close contact with the plane portion 204 and the respective slopes 205 and 206 of the socket member 200. At this time, the first magnet 110 and the second magnet 210 correspond to and are attached to each other, and the coupling protrusions 107 of the plug member 100 are fitted and coupled into the coupling recesses 207 in the socket member 200.

As seen in the sectional views, when the plug member 100 and the socket member 200 are coupled to each other, the centers of the first magnet 110 and the second magnet 210 may coincide with each other, and the respective slopes of the plug member 100 and the socket member 200, which come into close contact with each other, may have a slight distance therebetween. This serves to secure a slight movement space, which is required when the plug member 100 and the socket member 200 are initially pushed toward each other for unfastening the buckle.

The coupling configuration of the coupling protrusion 107 and the coupling recess 207 is illustrated in detail in FIGS. 8 and 9. As illustrated, the coupling protrusion 107 of the plug member 100 is provided on the front end thereof with a hook portion 108, the outer surface of the coupling protrusion 107 is configured as a curvilinearly inclined portion 109, and the coupling recess 207 in the socket member 200 is provided on the outer circumference thereof with a raised portion 208, which corresponds to the hook portion 108 of the coupling protrusion 107.

The coupling recess 207 may be larger than the coupling protrusion 107 in order to ensure smooth introduction of the coupling protrusion 107. In the state in which the plug member 100 and the socket member 200 are coupled to each other via the attachment of the first magnet 110 and the second magnet 210, the hook portion 108 of the coupling protrusion 107 is slightly spaced apart from the raised portion 208 of the coupling recess 207 so as to come into contact therewith when the plug member 100 and the socket member 200 are separated from each other in opposite directions or in the vertical direction.

However, since a general buckle used for the connection of a strap has the feature whereby the plug member 100 and the socket member 200 are adapted to pull each other so long as no opposing force is intentionally applied, the hook portion 108 and the raised portion 208 may continuously come into contact with each other in the state of facing each other so as to prevent unintentional separation of the buckle despite movement of the human body or the shock of an external contact that is greater than the magnetic attachment force.

In addition, although the plug member 100 and the socket member 200 may be separated from each other despite the contact of the hook portion 108 and the raised portion 208 when an attempt is made to vertically separate them from each other, such vertical separation is very difficult in the state in which the plug member 100 and the socket member 200 are attached to each other by the strong magnetic force. That is, separation of the plug member 100 and the socket member 200 is achieved only when each member is pushed in the forward direction thereof, such that the hook portion 108 and the raised portion 208 have no effect on each other.

To this end, the curvilinearly inclined portion 109 is formed on the front end of the coupling protrusion 107 opposite to the hook portion 108 so that the front end of the coupling protrusion 107 is gradually tapered so as to be easily separated from the coupling recess 207. The curvilinearly inclined portion 109 may be simply configured as an inclined portion.

In addition, the inner circumference of the coupling recess 207, which comes into contact with the curvilinearly inclined portion 109, is provided with an inclined guide portion 209, which smoothly guides the curvilinearly curved portion 109 of the coupling protrusion 107 outward.

Accordingly, the inner sidewall of the coupling recess 207 protrudes slightly at the middle portion thereof, and the inclined guide portion 209 extends from the protruding middle portion of the inner sidewall so as to outwardly expand the coupling recess 207. In the state in which the plug member 100 and the socket member 200 are magnetically coupled to each other, the root portion of the curvilinearly inclined portion 109 comes into contact with the outer circumference of the inclined guide portion 209, and the remaining portion of the curvilinearly inclined portion 109 and the inclined guide portion 209 are spaced apart from each other by a gradually increasing distance. To this end, the inclination angle f of the inclined guide portion 209 may be smaller than the inclination angle d of the curvilinearly curved portion 109.

The action of the buckle according to the present invention having the configuration described above will be described below.

Figure 10:
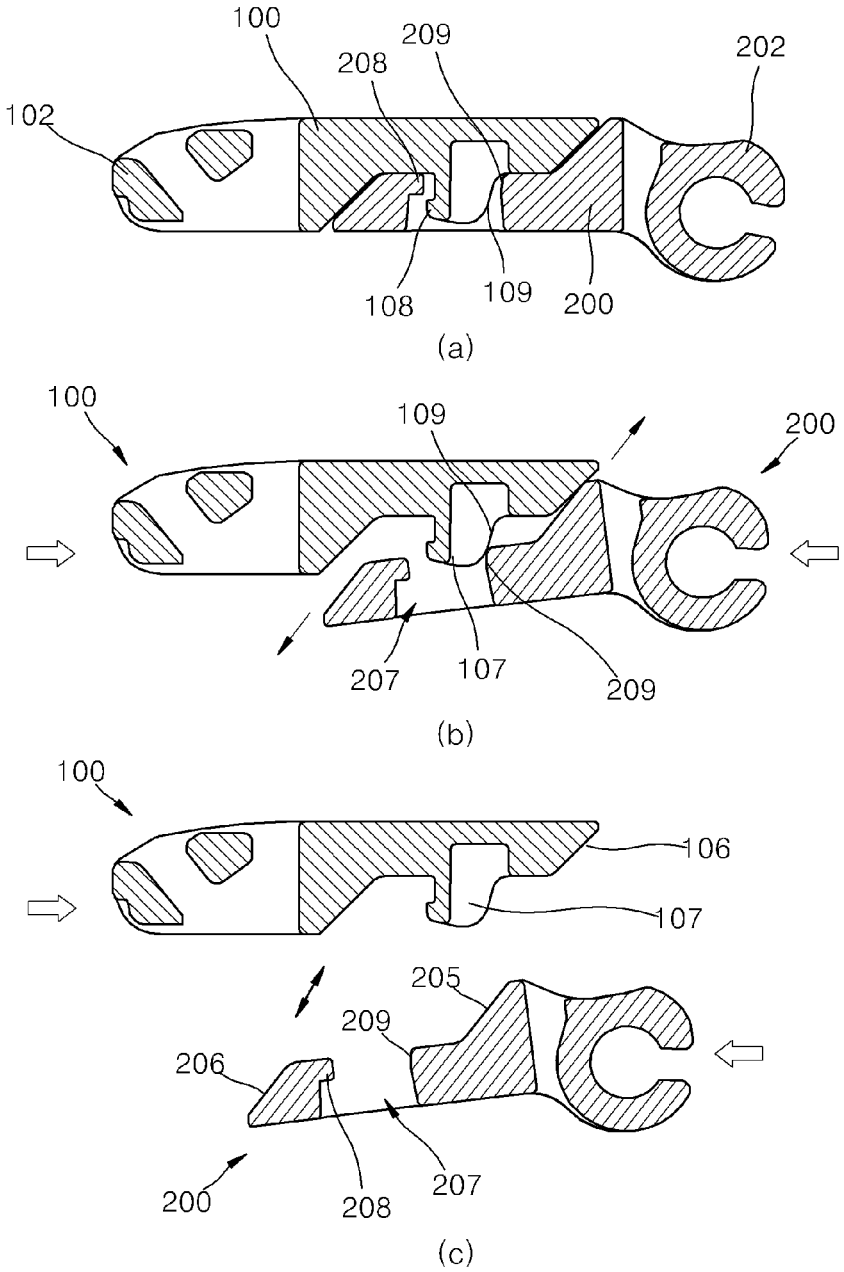
FIG. 10 is a sectional view illustrating the operational state of the buckle according to the present invention.

First, when one member, among the plug member 100 and the socket member 200, is brought close to the other member in order to couple the plug member 100 and the socket member 200 to each other, the plug member 100 and the socket member 200 attract each other by the magnetic force of the first magnet 110 and the second magnet 210, thereby causing the first magnet 110 and the second magnet 210 to be momentarily attached to each other. Thereby, as illustrated in FIG. 10(A), the plug member 100 and the socket member 200 are coupled to and come into close contact with each other.

The respective plane portions 104 and 204 of the plug member 100 and the socket member 200 come into close contact with each other, the plug inner-side slope 105 and the socket front-end slope 206 come into close contact with each other, the plug front-end slope 106 and the socket inner-side slope 205 come into close contact with each other, and the coupling protrusion 107 is momentarily inserted into and coupled to the coupling recess 207.

The coupling of the plug member 100 and the socket member 200, described above, is automatically performed with the strong magnetic attraction of the first magnet 110 and the second magnet 210, and the attachment of the first magnet 110 and the second magnet 210 is achieved at an accurate position by the guidance of contact of the crossing slopes. In the course of the momentary coupling, the coupling protrusion 107 is inserted into and seated in the coupling recess 207.

When the plug member 100 and the socket member 200 are simply pulled in opposite directions or vertically lifted while in the coupled state described above, the plug member 100 and the socket member 200 are not separated from each other owing to the coupling relationship between the hook portion 108 of the coupling protrusion 107 and the raised portion 208 of the coupling recess 207.

In order to separate the plug member 100 from the socket member 200, as illustrated in FIG. 10(B), pushing force is applied to the rear portions of the plug member 100 and the socket member 200 so as to push them forward toward each other. Through this pushing operation, the plug inner-side slope 105 and the socket front-end slope 206, which are located close to each other with a very slight gap therebetween, and the plug front-end slope 106 and the socket inner-side slope 205, which are located close to each other with a very slight gap therebetween, cross each other while sliding so as to naturally lift each other, thereby causing the attached surfaces of the first magnet 110 and the second magnet 210 to be separated from each other.

Simultaneously with the above-described operation, the curvilinearly inclined portion 109 of the coupling protrusion 107 slidably comes into contact with the inclined guide portion 209 of the coupling recess 207, thereby causing the coupling protrusion 107 to be smoothly separated from the coupling recess 207. Thereby, as illustrated in FIG. 10(C), the plug member 100 and the socket member 200 are separated from each other.

Accordingly, the plug member 100 and the socket member 200 according to the present invention may be simply separated from each other when they are pushed toward each other, rather than being pulled in opposite directions for separation therebetween as in the case of a conventional buckle.

Because the plug member 100 and the socket member 200 may be momentarily coupled to each other by the magnets 110 and 210, even while the coupling between the plug member 100 and the socket member 200 is being implemented with one hand, an operation of coupling and separating, for example, a belt or a strap may be performed with the other hand in some cases. The ability to perform different operations at the same time with respective hands is very advantageous.

For example, in a situation, such as, for example, performing any of various tasks or climbing, one hand may often be used to grip or hold something. In this situation, it may be difficult to couple or release a buckle using two hands.

Therefore, the fact that the buckle may be coupled or released with only one hand in the situation mentioned above may provide excellent convenience. In particular, even if the user wears thick gloves, the user may simply unfasten the buckle of the present invention by gripping the plug member 100 and the socket member 200 and pushing rear portions thereof with one hand.

Figure 11:
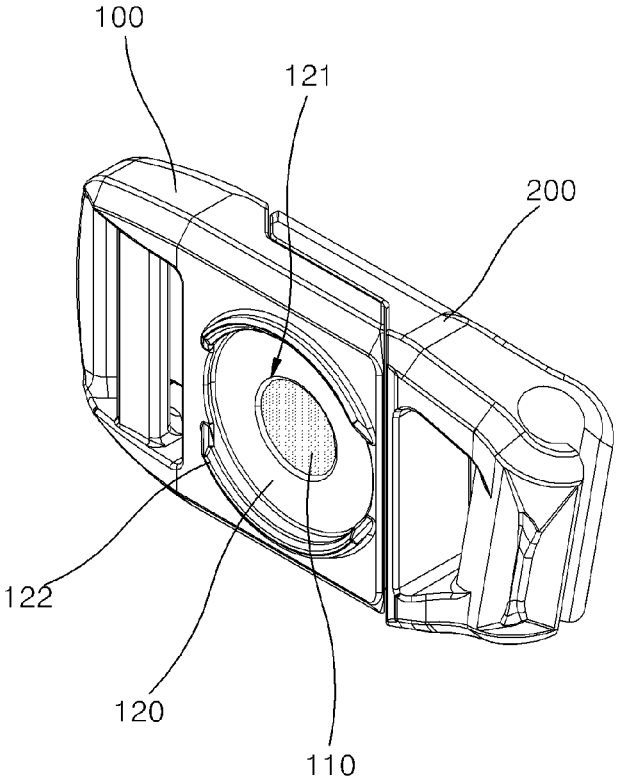
FIG. 11 is a perspective view illustrating another embodiment of the buckle according to the present invention.
Figure 12:
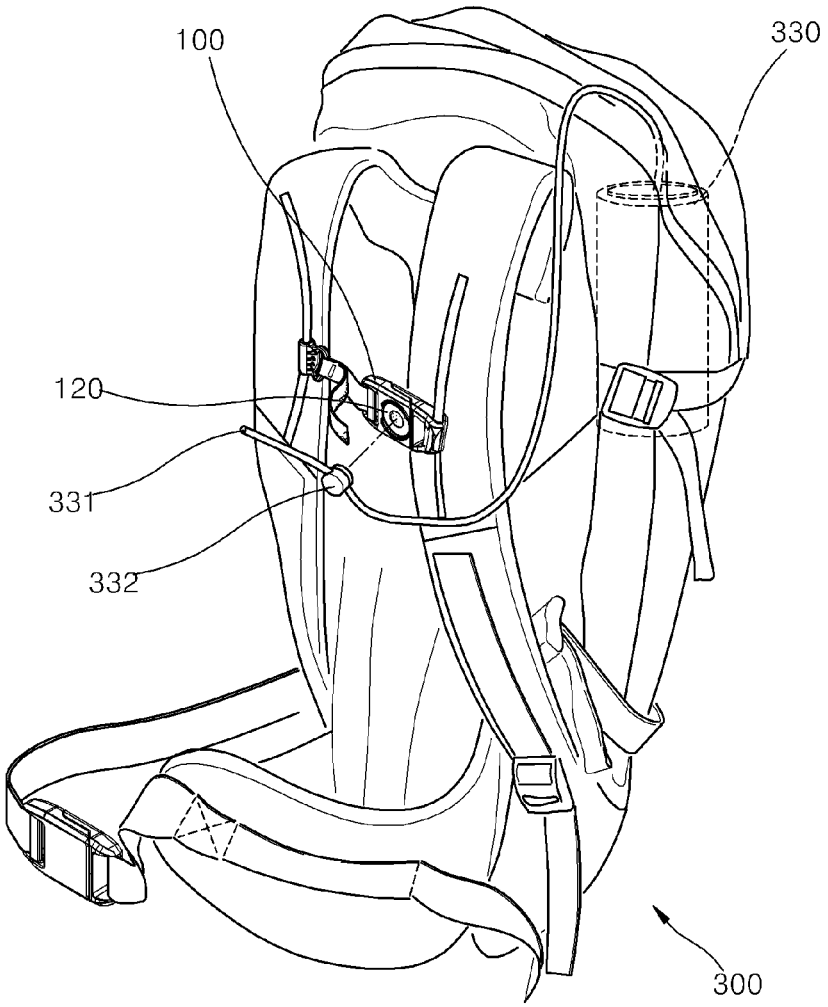
FIG. 12 is a view illustrating an embodiment in which the buckle of FIG. 11 is applied to a knapsack.

FIGS. 11 and 12 illustrate another embodiment of the present invention. Referring to FIGS. 11 and 12, in addition to the configuration illustrated in the embodiment of FIGS. 2 to 10, in the present embodiment, a seating recess 120 is formed in the outer surface of the plug member 100 in order to enable the attachment of any small article using an external magnet or any external attachment member that is influenced by magnetic force.

The seating recess 120 is formed at a position that is coincident with the first magnet 110 inside the plug member 100. An aperture 121 is formed in the center of the seating recess 120 so that the magnetic force of the first magnet 110 is directly transferred to the outside through the aperture 121, and a support rim portion 122 is formed on the outer circumference of the seating recess 120.

When the user who wears a knapsack goes climbing or trekking, the user may carry a water bottle 330 or a water container in the knapsack 300 illustrated in FIG. 12, and may try to drink water through a hose 331 of the water bottle 330 without taking off the knapsack 300. In this case, a fixing member 332, which is formed of a metal that responds to magnetic force or an external magnet, may be installed on the chest strap 320 so as to be attached to the end of the hose 331. Thereby, when the fixing member 332 is seated in the seating recess 120 of the buckle according to the present invention, it may assist the user in conveniently carrying the hose 331 and drinking water through the hose 331 as needed.

The fixing member 332 may remain in the stably attached state due to the magnetic force while seated in the seating recess 120, and may also remain in the firmly fixed state without easy separation due to the support rim portion 122, which is formed on the outer circumference of the seating recess 120.

As is apparent from the above description, in a configuration in which a plug member and a socket member are coupled to each other according to the present invention, the plug member and the socket member may be coupled to each other using magnets without lock arms for fastening therebetween, which may result in a simplified configuration, increased productivity, and reduced manufacturing costs.

According to the present invention, the plug member and the socket member are respectively provided with magnets, which correspond to each other so as to be coupled to each other via strong magnetic attraction therebetween even when they are simply brought close to each other. Thereby, the coupling and separation may be conveniently achieved with only one hand. In addition, the coupled state of the plug member and the socket member may be stably maintained by, for example, a coupling protrusion and a coupling recess formed on the plug member and the socket member so as to correspond to each other.

In addition, through the use of the magnets for coupling the plug member and the socket member to each other, a hose of a water bottle or some other small article may be simply attached to and carried along with the buckle according to the present invention.

What is claimed is:

1. A buckle for a chest strap of a knapsack, comprising: a plug member including a plug plane portion formed at a front side of a plug member base so as to be connected to the plug member base via a plug inner-side slope, a plug front-end slope extending forward from the plug plane portion, a first magnet embedded in a middle portion of the plug plane portion, and coupling protrusions aligned vertically and protruding from opposite sides of the first magnet; and a socket member including a socket plane portion formed at a front side of a socket member base so as to be connected to the socket member base via a socket inner-side slope, a socket front-end slope extending forward from the socket plane portion, a second magnet embedded in a middle portion of the socket plane portion, and coupling recesses formed in opposite sides of the second magnet so as to correspond to the respective coupling protrusions, wherein the plug member and the socket member are separably connected to each other, wherein each of the coupling protrusions of the plug member includes a hook portion formed on an inner front end thereof and a curvilinearly curved portion formed on an outer surface thereof, and each of the coupling recesses of the socket member includes a raised portion formed on an outer circumference thereof so as to correspond to the hook portion of each of the coupling protrusions, and wherein each of the coupling recesses of the socket member further includes an inclined guide portion formed on an inner circumference thereof so as to define an upwardly expanded opening so that the inclined guide portion comes into contact with the curvilinearly inclined portion to enable easy separation of each of the coupling protrusions of the plug member from each of the coupling recesses.

2. The buckle according to claim 1, wherein each of an exterior angle between the plug plane portion and the plug inner-side slope, an interior angle between the plug plane portion and the plug front-end slope of the plug member, an exterior angle between the socket plane portion and the socket inner-side slope, and an interior angle between the socket plane portion and the socket front-end slope of the socket member is an obtuse angle having a same degree.

3. The buckle according to claim 1, wherein, when the plug member and the socket member are coupled to each other so that the plug plane portion and the socket plane portion are attached to face each other by the first and second magnets, the plug front-end slope and the socket inner-side slope are located close to each other so as to face each other, and the socket front-end slope and the plug inner-side slope are located close to each other so as to face each other.

4. The buckle according to claim 1, wherein the inclined guide portion has a smaller inclination angle than an inclination angle of the curvilinearly inclined portion.

5. The buckle according to claim 1, wherein each of the plug member or the socket member includes either a cross-bar or a strap-hooking bar, which are selectively formed at a rear side of the respective plug member base or socket member base.

6. The buckle according to claim 1, wherein the plug member or the socket member includes an elevating rail holder provided on a rear end thereof so as to be vertically movably coupled to a rail, which is installed on a shoulder strap of the knapsack.

7. The buckle according to claim 1, wherein the plug member includes a seating recess formed in an outer surface thereof so that an external magnet, which corresponds to the first magnet embedded in the plug member, is seated.

8. The buckle according to claim 7, wherein the seating recess and the embedded first magnet are connected to each other via an aperture.

9. The buckle according to claim 7, wherein the seating recess is provided on a circumference thereof with a protruding support portion to support the external magnet seated in the seating recess.

10. A buckle for a chest strap of a knapsack, comprising:

a plug member including a plug plane portion formed at a front side of a plug member base so as to be connected to the plug member base via a plug inner-side slope, a plug front-end slope extending forward from the plug plane portion, a first magnet embedded in a middle portion of the plug plane portion, coupling protrusions vertically aligned and protruding from opposite sides of the first magnet, and a seating recess formed in an outer surface of the plug plane portion; and a socket member including an elevating rail holder having a circular cross-sectional rail groove formed at a rear side of a socket member base, a socket plane portion formed at a front side of the socket member base so as to be connected to the socket member base via a socket inner-side slope, a socket front-end slope extending forward from the socket plane portion, a second magnet embedded in a middle portion of the socket plane portion, and coupling recesses formed in opposite sides of the second magnet so as to correspond to the respective coupling protrusions, wherein the plug member and the socket member are separably connected to each other wherein each of the coupling protrusions of the plug member includes a hook portion formed on an inner front end thereof and a curvilinearly curved portion formed on an outer surface thereof, and each of the coupling recesses of the socket member includes a raised portion formed on an outer circumference thereof so as to correspond to the hook portion of each of the coupling protrusions, and wherein each of the coupling recesses of the socket member further includes an inclined guide portion formed on an inner circumference thereof so as to define an upwardly expanded opening so that the inclined guide portion comes into contact with the curvilinearly inclined portion to enable easy separation of each of the coupling protrusions of the plug member from each of the coupling recesses.

* * * * *